US007772787B2

(12) United States Patent
Ashdown et al.

(10) Patent No.: US 7,772,787 B2
(45) Date of Patent: Aug. 10, 2010

(54) LIGHT SOURCE AND METHOD FOR OPTIMISING ILLUMINATION CHARACTERISTICS THEREOF

(75) Inventors: Ian Ashdown, West Vancouver (CA); Marc Salsbury, Vancouver (CA)

(73) Assignee: Koninklijke Philips Electronics N.V., Eindhoven (NL)

( * ) Notice: Subject to any disclaimer, the term of this patent is extended or adjusted under 35 U.S.C. 154(b) by 476 days.

(21) Appl. No.: 11/777,008

(22) Filed: Jul. 12, 2007

(65) Prior Publication Data

US 2008/0013314 A1 Jan. 17, 2008

Related U.S. Application Data

(60) Provisional application No. 60/830,456, filed on Jul. 13, 2006.

(51) Int. Cl.
*H05B 37/02* (2006.01)

(52) U.S. Cl. ..... 315/291; 315/156; 315/312

(58) Field of Classification Search ..... 315/149, 315/156–159, 291, 307, 312; 362/231
See application file for complete search history.

(56) References Cited

U.S. PATENT DOCUMENTS

| | | | | |
|---|---|---|---|---|
| 5,451,063 | A | 9/1995 | Udagawa et al. | |
| 6,188,181 | B1 * | 2/2001 | Sinha et al. | 315/293 |
| 6,411,046 | B1 | 6/2002 | Muthu | |
| 6,692,136 | B2 | 2/2004 | Marshall et al. | |
| 6,817,735 | B2 | 11/2004 | Shimizu et al. | |
| 6,900,471 | B1 | 5/2005 | Wicke et al. | |
| 7,008,078 | B2 | 3/2006 | Shimizu et al. | |
| 2003/0052616 | A1 | 3/2003 | Antoniadis et al. | |
| 2004/0211888 | A1 | 10/2004 | Shur et al. | |
| 2005/0062440 | A1 * | 3/2005 | Lys et al. | 315/291 |

(Continued)

FOREIGN PATENT DOCUMENTS

CA 2515263 A1 2/2006

(Continued)

OTHER PUBLICATIONS

Commission Internationale de 1' Eclairage (CIE) 13.3, 1995, Technical Report "Method of Measuring and Specifying Colour Rendering Properties of Light Sources."

(Continued)

*Primary Examiner*—Douglas W Owens
*Assistant Examiner*—Tung X Le

(57) ABSTRACT

The present invention provides a light source, method, computer-readable storage medium and computer program product for optimising one or more illumination characteristic thereof. In particular, the present invention provides a light source comprising four or more light-emitting elements, or groups or arrays thereof, each one of which having a respective predefined emission spectrum which, when combined in accordance with a given intensity ratio, provide illumination at a particular color temperature. This light source may comprise an internal and/or external selection module for selecting one or more illumination characteristics to be optimised, and internal and/or external computing module for optimising drive parameters of the light source to provide the optimised illumination characteristic selected. The light source may optionally be hardwired to operate according to predefined drive parameters selected, using a method, computer-readable storage medium and/or computer program product of the present invention, in order to optimise a pre-selected illumination characteristic.

24 Claims, 7 Drawing Sheets

U.S. PATENT DOCUMENTS

| | | | | |
|---|---|---|---|---|
| 2005/0161586 | A1 | 7/2005 | Rains, Jr. et al. | |
| 2005/0237733 | A1 | 10/2005 | Laski et al. | |
| 2006/0006821 | A1 * | 1/2006 | Singer et al. | 315/312 |
| 2006/0022582 | A1 | 2/2006 | Radkov | |
| 2006/0022999 | A1 | 2/2006 | Lee et al. | |
| 2006/0097245 | A1 | 5/2006 | AaNegola et al. | |
| 2007/0223219 | A1 * | 9/2007 | Medendorp et al. | 362/231 |
| 2007/0273290 | A1 * | 11/2007 | Ashdown et al. | 315/113 |
| 2009/0046453 | A1 * | 2/2009 | Kramer | 362/231 |

FOREIGN PATENT DOCUMENTS

| | | | |
|---|---|---|---|
| WO | 03055273 | A2 | 7/2003 |
| WO | 2004025998 | A2 | 3/2004 |
| WO | 2004100611 | A1 | 11/2004 |

OTHER PUBLICATIONS

Commission Internationale de 1' Eclairage (CIE) 15.2. Table 2.1, 1996, Technical Report "Methodof Measuring and Specifying Colour Rendering Properties of Light Sources."

Y. Ohno, Toward an Improved Colour Rendering Metric, SPIE 2005.

J. Lagarias, et al; Convergence Properties of the Nelder-Mead Simplex Method in Low Dimensions, SIAM, Journal of Optimisation vol. 9, No. 1, 1998.

* cited by examiner

LIGHT SOURCE AND METHOD FOR OPTIMISING ILLUMINATION CHARACTERISTICS THEREOF

FIELD OF THE INVENTION

The present invention pertains to the field of lighting and in particular to a light source, and method, computer-readable storage medium and computer program product for optimising illumination characteristics thereof.

BACKGROUND

Advances in the development and improvements of the luminous flux of light-emitting devices such as solid-state semiconductor and organic light-emitting diodes (LEDs) have made these devices suitable for use in general illumination applications, including architectural, entertainment, and roadway lighting. Light-emitting diodes are becoming increasingly competitive with light sources such as incandescent, fluorescent, and high-intensity discharge lamps.

In particular, some general-purpose LED-based light sources have been proposed to provide a good color rendering performance comparable with currently used general-purpose light sources. For instance, certain types of phosphor-coated LEDs (pc LEDs) have been developed to provide a reasonably good white light source, wherein emissions from the LED induce, and sometimes combines with, emissions from the phosphorous coating to produce the white light.

Other LED-based light sources are generally disclosed to provide white light by combining the emissions of at least three LEDs, the wavelengths of which being specifically selected to optimise the color rendering index (CRI) of the disclosed light source. For instance, in U.S. Pat. No. 5,851,063 for a Light-Emitting Diode White Light Source, issued Dec. 22, 1998 to Doughty et al., a system of at least three multicolored LEDs is disclosed to have an optimised CRI by proper selection of the wavelengths of each LED. The disclosed system is said to be useful for general illumination purposes due to its optimised CRI. In U.S. Pat. Nos. 7,008,078 and 6,817,735, a light source is disclosed to include four different types of LEDs, namely a blue LED, a blue-green LED, an orange LED and a red LED, each respectively emitting light within a predefined range of wavelengths selected to provide a high efficiency and a high color rendering performance.

Further LED-based light sources have been disclosed to comprise a feedback system enabling such light sources to adjust an output of the light-source's LEDs as a function of a feedback signal in order to substantially maintain a desired output. For example, feedback signals related to light source output color, intensity or operating temperature are used to adjust an output of the light source to substantially maintain a pre-set operating condition. Examples of such light sources are provided in U.S. Pat. No. 6,411,046, United States Patent Application Nos. 2005/0237733, 2005/0161586 and 2004/0211888, and International Application Nos. WO 2004/025998 and WO 2004/100611.

Some challenges, however, still need to be resolved to adapt current and upcoming LED technology to general illumination applications. For instance, in order to make general purpose LED-based light sources competitive with, and ultimately surpass, currently available general purpose light sources, techniques must be developed to improve and preferably optimise the general illumination characteristics of such LED-based devices via optimised drive parameters. Namely, though LED-based technologies have been disclosed to optimise the CRI of LED-based light sources by selecting specific LED wavelengths conducive to such optimisation, these wavelength optimisation techniques are generally only applicable for a prescribed correlated color temperature (CCT) and, in practice, can raise cost issues associated with the sort of binning required for the manufacture of these optimised light sources. As such, there is a need for light source solutions using currently available LEDs and/or other such light emitting elements, or again using newly developed light-emitting elements, which can not only improve and/or optimise the CRI of such light sources, but also optionally improve and/or optimise for other selected illumination characteristics of such devices, such as, for example, the color quality scale (CQS), the luminous efficacy and/or the output power.

This background information is provided to reveal information believed by the applicant to be of possible relevance to the present invention. No admission is necessarily intended, nor should be construed, that any of the preceding information constitutes prior art against the present invention.

SUMMARY OF THE INVENTION

An object of the present invention is to provide a light source and method for optimising illumination characteristics thereof. In accordance with an aspect of the present invention, there is provided a light source, comprising: four or more light-emitting elements, each one of which having a respective emission spectrum; a selection module for selecting one or more illumination characteristics for which the light source is to be optimised; a computing module for computing, from values indicative of each said respective emission spectrum, optimised drive parameters for driving the light source to substantially attain said selected one or more illumination characteristics; and a driving module for driving each of said four or more light-emitting elements in accordance with said optimised drive parameters.

In accordance with another aspect of the present invention, there is provided a method for driving a light source in accordance with drive parameters that optimise one or more illumination characteristics of the light source, the light source comprising four or more light-emitting elements each having a respective emission spectrum, the method comprising: identifying for each of the four or more light emitting elements, one or more values indicative of its respective emission spectrum; selecting the one or more illumination characteristics for which the light source is to be optimised; calculating, using each said one or more values, the drive parameters that optimise for said selected one or more illumination characteristics; and driving the light source in accordance with said calculated drive parameters.

In accordance with another aspect of the present invention, there is provided a computer-readable storage medium having embodied therein instructions for operating a computing module to determine drive parameters for optimising one or more selected illumination characteristics of a light source, the light source comprising four or more light-emitting elements each having a respective emission spectrum, in accordance with the following: for each of said four or more light emitting elements, receiving as input one or more values indicative of the respective emission spectrum; receiving as a selected input the one or more selected illumination characteristics; calculating, from each said one or more indicative values and said selected input, the drive parameters that optimise the selected one or more illumination characteristics; and outputting said calculated drive parameters for use in driving the light source in accordance with the selected one or more illumination characteristics.

DETAILED DESCRIPTION OF THE INVENTION

Definitions

Figure 1:
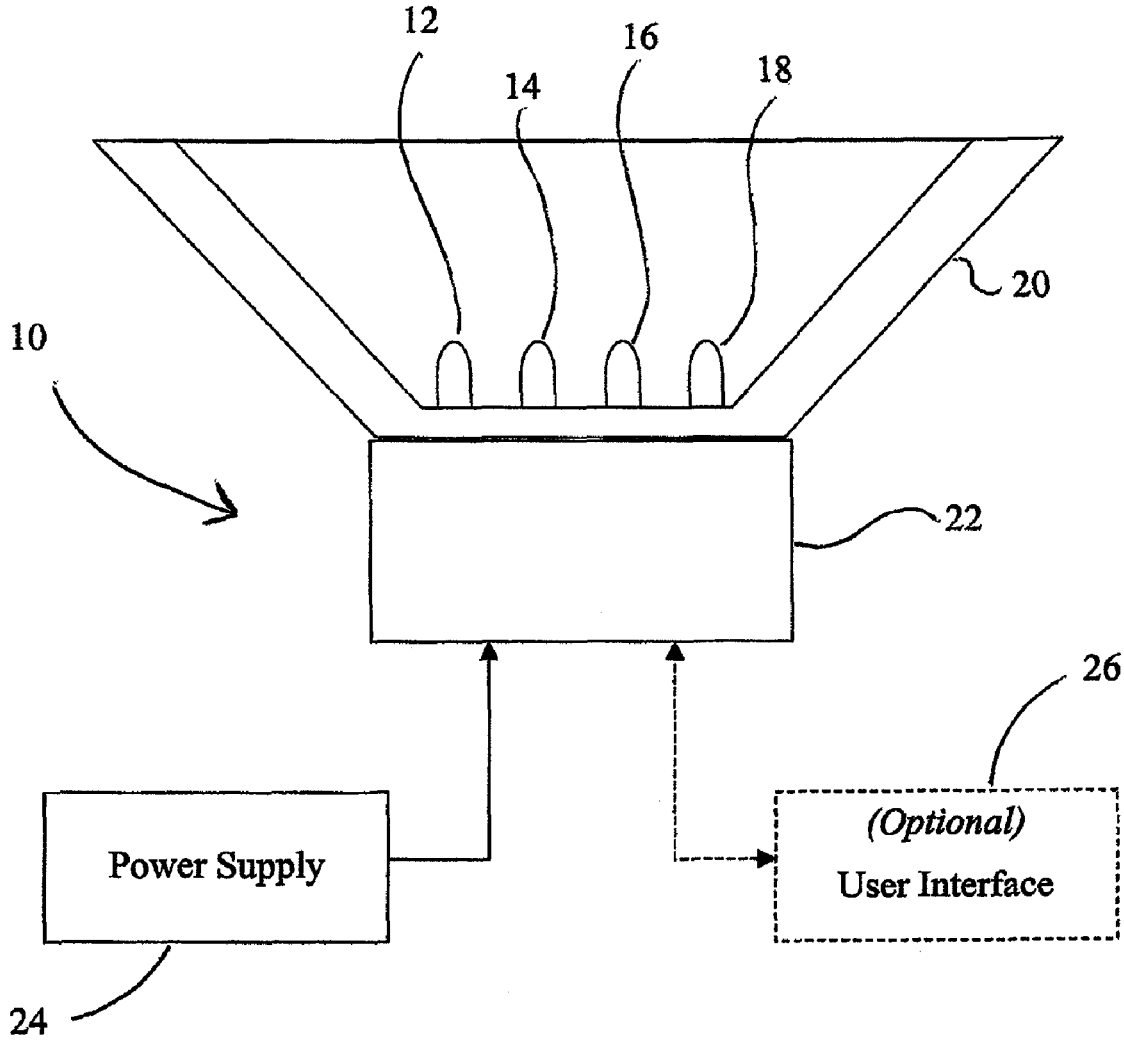
FIG. 1 is a diagrammatical representation of a RAGB light source in accordance with one embodiment of the present invention.

The term "light-emitting element" is used to define a device that emits radiation in a region or combination of regions of the electromagnetic spectrum for example, the visible region, infrared and/or ultraviolet region, when activated by applying a potential difference across it or passing a current through it, for example. Therefore a light-emitting element can have monochromatic, quasi-monochromatic, polychromatic or broadband spectral emission characteristics. Examples of light-emitting elements include semiconductor, organic, or polymer/polymeric light-emitting diodes, optically pumped phosphor coated light-emitting diodes, optically pumped nano-crystal light-emitting diodes or other similar devices as would be readily understood by a worker skilled in the art. Furthermore, the term light-emitting element is used to define the specific device that emits the radiation, for example a LED die, and can equally be used to define a combination of the specific device that emits the radiation together with a housing or package within which the specific device or devices are placed.

The term "illumination characteristic" is used to define a characteristic of a given light source that may be optimised via an embodiment of the present invention. Such illumination characteristics may include, but are not limited to, the color-rendering index (CRI), the color quality scale (CQS), the power output, the chromaticity and the luminous efficacy of the given light source. Other such illumination characteristics will become apparent to the person of skill in the art upon reference to the following disclosure, and as such, should not be considered to depart from the general scope and nature of the present disclosure. Furthermore, it will be understood that the above exemplary illumination characteristics, as defined in greater detail herein in accordance with different embodiments of the present invention, may be defined using any appropriate mathematical, analytical, numerical, quantitative and/or qualitative definition without departing from the general scope and nature of the present disclosure.

The term "drive parameter" is used to define any parameter and/or attribute defined for driving, operating and/or controlling a given light source. Using various embodiments of the present invention, these "drive parameters" may be determined and/or set to optimise one or more illumination characteristics of the given light source. Such drive parameters may include, but are not limited to, the duty cycle of light-emitting elements comprised within the given light source, the relative intensities of these light-emitting elements, the current(s) for driving the light-emitting elements, the type of driving mechanism (e.g. pulse width modulation, pulse code modulation, etc.) and parameters thereof, the operating or junction temperature, and the like. Other such drive parameters will become apparent to the person of skill in the art upon reference to the following disclosure, and as such, should not be considered to depart from the general scope and nature of the present disclosure.

As used herein, the term "about" refers to a +/−10% variation from the nominal value. It is to be understood that such a variation is always included in any given value provided herein, whether or not it is specifically referred to.

Unless defined otherwise, all technical and scientific terms used herein have the same meaning as commonly understood by one of ordinary skill in the art to which this invention belongs.

The present invention provides a light source, and method, computer-readable storage medium and computer program product for optimising one or more illumination characteristics thereof. In particular, the present invention provides a light source comprising four or more light-emitting elements, or groups, clusters or arrays thereof, each one of which having a respective emission spectrum which, when combined in accordance with a given intensity ratio, provide illumination at a particular color temperature.

The light source, according to one embodiment of the present invention, may comprise an internal and/or external selection module (e.g. switch, button, slide or scroll bar, lever, and other such physical selection modules, hardwired switch, software application/graphical user interface selection module, firmware module, hardware module, and/or other such selection means) for selecting one or more illumination characteristics to be optimised, as defined above, and an internal and/or external computing module (e.g. processor, computing platform, communicatively linked personal computer and/or PDA, remote control platform, and/or other such computing means) for optimising drive parameters of the light source, also as defined above, to provide the one or more optimised illumination characteristics selected.

In one embodiment, the light source may be hardwired and/or pre-configured to operate according to predefined drive parameters selected, using an embodiment of the method, computer-readable storage medium and/or computer program product of the present invention, to optimise one or more pre-selected illumination characteristics of the light source.

As is known in the art, for a light source made up of red, green and blue light-emitting elements (e.g. LEDs), such as a luminaire, there is a unique combination of the light-emitting elements that will give a particular color temperature. As such, for a system comprising three light-emitting elements, the relative intensity of each such element is not optimised, but rather solved.

By contrast, in a light source comprising at least four light-emitting elements, or groups, clusters or arrays thereof, each one of which having a respective emission spectrum the determination of intensity ratios between the at least four light-emitting elements for a given color temperature is an underconstrained problem, and thus has multiple solutions. For example, for a light source comprising one or more red light-emitting elements (R), one or more amber light-emitting elements (A), one or more green light-emitting elements (G) and one or more blue light-emitting elements (B), the R:A:G:B ratios for a given color temperature is an underconstrained problem. As a result, some of these solutions generally provide better illumination characteristics than others, depending on the illumination characteristic(s) most suitable to an application for which the light source is to be used.

For the purpose of the following discussion, examples will be described with reference to a light source comprising red, amber, green and blue light-emitting elements, otherwise RAGB light sources. It will be appreciated that other color combinations may be considered herein without departing from the general scope and nature of the present disclosure, as can various and different types of light-emitting elements, as defined above, may be considered within a same light source.

One aspect of the present invention provides a method, computer-readable storage medium and computer program product for optimising drive parameters of a given light source, which comprises four or more light-emitting elements, or groups, clusters or arrays thereof, to optimise the one or more illumination characteristics most suitable for the application for which the given light source is to be used.

In one embodiment, drive parameters are determined to optimise one illumination characteristic.

In one embodiment, drive parameters are determined to optimise two illumination characteristics simultaneously.

In one embodiment, a user of the light source is provided with the option of selecting for which illumination characteristic(s) the drive parameters are to be optimised. Other such embodiments should be apparent to the person of skill in the art and are thus not meant to depart from the general scope and nature of the present disclosure.

As will be described in greater detail below, illumination characteristics that may be balanced in such an optimisation may include, but are not limited to, the color-rendering index (CRI), the color quality scale (CQS), the total output (photopic) power and the luminous efficacy, to name a few. In one embodiment of the present invention, both the CRI and luminous efficacy are assigned a relative weight and the R:A:G:B balance of a given light source is optimised for that weighting. In one embodiment, the total output (photopic) power and the color quality scale (CQS) value of the light source are considered. In one embodiment, the CRI, CQS, efficacy and output power are all considered, or alternatively, selectively considered as a function of a weighting respectively assigned to each of these characteristics. Other such embodiments and alternatives will be apparent to the person of skill in the art. Namely, the person of skill in the art will understand, upon reference to the following description, that various scenarios involving the optimisation of a combination of the above and other such illumination characteristics may be considered without departing from the general scope and nature of the present disclosure. For instance, in one embodiment, one or more illumination characteristics are optimised independently, whereas in another embodiment, various illumination characteristics are optimised simultaneously.

In addition, the optimal balance of the light-emitting element intensities generally change with temperature due to the high thermal sensitivity common to a number of currently available light-emitting elements. For example, as discussed further below, the output power of an AlInGaP LED will generally drop off dramatically as its substrate is heated, such that a solution determined for a system operating these LEDs at 25° C. will be very different from a solution for the same system operating at 95° C. Therefore, to maintain a substantially constant output using such LEDs, the duty cycle thereof, for example, is generally increased as the operating temperature of the system increases. Consequently, in one embodiment of the present invention, the effects of temperature on the behavior of the light-emitting elements are included in the optimisation routine such that the solution for a given system is optimised for the actual, or expected, operating temperature of this system.

The person of skill in the art will understand that the above is not limited to an RAGB system. It can be directly applied to a system containing various combinations of different color light-emitting elements, which may comprise four or more different light-emitting elements, or groups, arrays or clusters thereof.

Light Source

Figure 2:
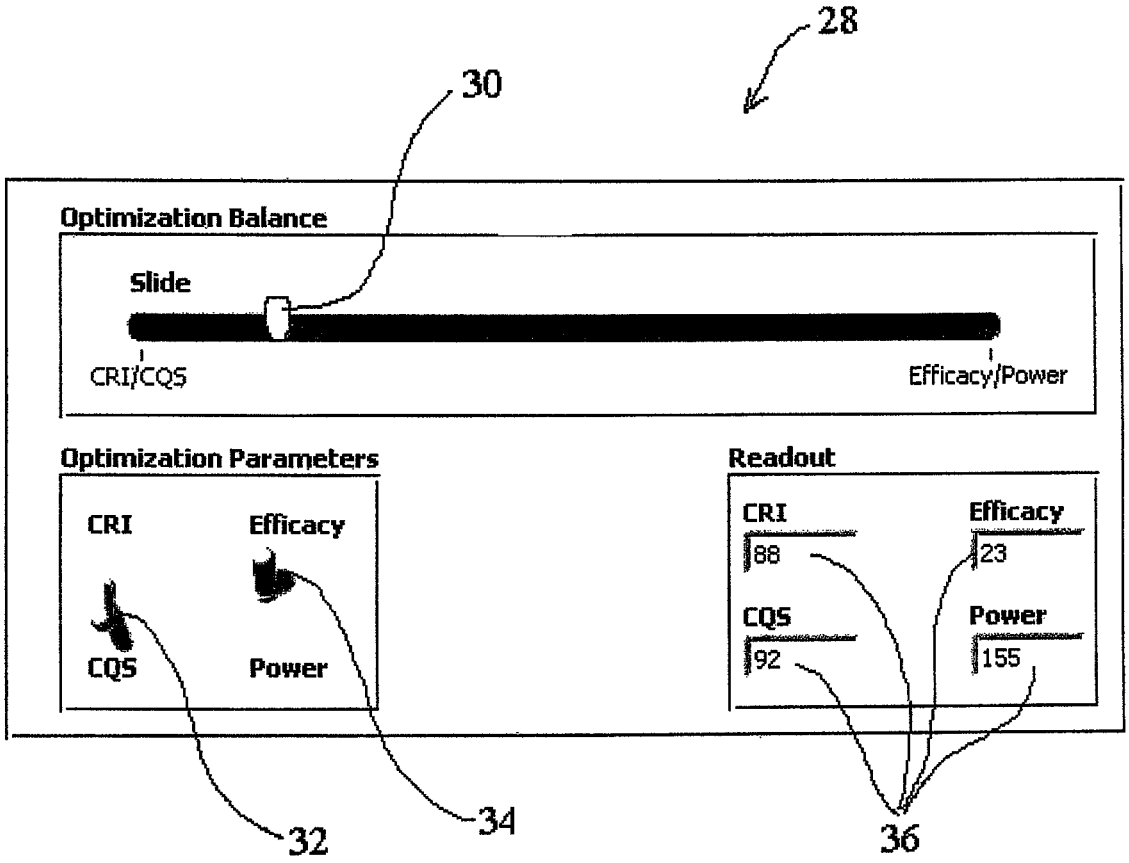
FIG. 2 is a front face view a control panel operatively coupled to a light source to provide an optional user interface for interactively controlling an optimisation of one or more illumination characteristics of the light source, in accordance with one embodiment of the present invention.

Referring to FIGS. 1 and 2, a light source, generally referred to using the numeral 10, and in accordance with one embodiment of the present invention, will now be described. The light source 10 generally comprises at least four light emitting elements, as in elements 12, 14, 16 and 18, configured to emit light of respective colors (e.g., red, amber, green and blue—RAGB), namely in accordance with respective emission spectra. For instance, the emission spectrum of a given light-emitting element may be defined by any combination of a peak emission wavelength, a representative bandwidth (e.g., full or half width at half max, etc.), and the like. It is to be understood that although the light source 10 is illustrated as comprising four discrete light-emitting elements of different colors, various combinations, configurations, agglomerations, grouping and/or array of such elements may also be considered without departing from the general scope and nature of the present disclosure.

The light source 10 also illustratively comprises a housing 20, through which the combined outputs of the light emitting elements 12, 14, 16, 18 are to be projected, and a base unit 22 adapted to be operatively coupled to an internal and/or external power supply 24. An optional user interface 26, which may include, but is not limited to, any combination of a graphical user interface, a physical hardwire switching device, an electrical switching device, and the like, may also be used to selectively operate and customise an optimisation of one or more illumination characteristics of the light source 10.

As will be apparent to a person skilled in the art, the light source 10 illustrated in FIG. 1 is provided as an example only. Various optical and/or operational configurations may be considered without departing from the general scope and nature of the present disclosure. For instance, though only four light-emitting elements 12, 14, 16 and 18 are illustrated in this figure, a different number and/or combination of light-emitting elements may be combined in a given light source 10 to provide optimised illumination characteristics, as presented hereinabove and described in further detail below. Namely, the light source 10 may comprise anywhere from four independent light-emitting elements, as illustrated, or one or more arrays of such elements for each selected color (e.g., an array of red light-emitting elements, an array of amber light-emitting elements, an array of green light-emitting elements and an array of blue light-emitting elements, etc.), and that, in any combination and/or spatial configuration. Furthermore, the housing 20 may comprise any number of optical and/or non-optical components to provide a variety of optical effects. These components may include, but are not limited to, one or more reflective surfaces, lenses, diffusers, and the like, used in different combinations to provide a desired effect.

The base unit 22 generally provides the drive module (e.g. circuitry, hardware, firmware, software, etc.) for driving and/or controlling the light source 10. Namely, as will be discussed further below, the base unit 22 may be configured to drive the light-emitting elements 12, 14, 16, 18 in accordance with drive parameters determined to optimise one or more selected illumination characteristics. As will be understood by the person skilled in the art, such driving and/or controlling means may include, but are not limited to, hardware, firmware, software and/or a combination of fixed and/or variable control circuitry. This base unit, illustratively powered by the power supply 24, may be encapsulated within a single module integral to the light source 10, as illustrated in FIG. 1, or provided as a separate module operatively connectable to the light source 10. Alternatively, drive and/or control means/modules (e.g., circuitry, software, hardware, firmware, and/or other such controllers/drivers) may be distributed between an integral base unit, as in unit 22, and an external control unit (not shown).

In general, the base unit 22 may be configured to operate the light source 10 in accordance with optimised parameters that are either pre-programmed into the light source 10, or selectively variable by a user or programmer thereof. For instance, in one embodiment, the base unit 22 of the light source 10 is pre-configured to operate in accordance with predefined drive parameters that where determined to optimise one or more pre-selected illumination characteristics of the light source 10. In this embodiment, the optimised drive parameters are defined during manufacture of the light source 10, and can be hardwired or pre-programmed to produce the one or more pre-selected optimised illumination characteristics.

In one embodiment, the light source is operable via the optional user interface 26 that is configured to provide a user thereof control over which illumination characteristic is to be optimised for. FIG. 2 illustrates a control panel 28 according to one embodiment of the present invention, wherein the control panel acts as the user interface 26. This panel 28, which may, for example, be used to implement an optimisation of one or more selected illumination characteristics via firmware integral to the light source 10, provides a selection module, e.g. comprising a slide bar 30 and selection switches 32 and 34, for selecting a desired illumination characteristic for which the light source 10 is to be optimised. A display, as in display 36, is also illustratively provided for displaying values indicative of various illumination characteristics of the light source 10 resulting from the selected optimisation.

The person of skill in the art will understand that various other types of user inputs and/or interfaces may be considered, for any of the above and other such embodiments of the present invention, without departing from the general scope and nature of the present disclosure. For instance, in an embodiment where optimised drive parameters are hardwired within the light source 10 during manufacturing, a user interface may be provided to the light source designer and/or manufacturer to optimise each item, or each batch of similar items, in accordance with one or more illumination characteristics pre-selected for optimisation. This interface may again be hardwired into a design and/or manufacturing system running an embodiment of the computer program product or comprising the computer-readable storage medium of the present invention, or provided in conjunction with an independently operated embodiment of this computer program product or computer-readable storage medium. Further details concerning the operation, use and outputs of these embodiments will be provided further below with reference to FIGS. 3 to 7.

Illumination Characteristics

As presented hereinabove, the present invention provides for the optimisation of one or more illumination characteristics of a light source. For example, as in light source 10 of FIG. 1, comprising at least four light-emitting elements, as in elements 12, 14, 16 and 18 (e.g., a RAGB luminaire). The following defines a number of illumination characteristics for which a light source, as described above, may be optimised in accordance with various embodiments of the present invention. The person of skill in the art will understand that other such illumination characteristics may be considered for optimisation without departing from the general scope and nature of the present disclosure.

The color-rendering index (CRI) is a measure of how well a light source renders color. In one embodiment, for a given source, it is calculated as detailed by the Commission International de l'Eclair age (CIE) 13.3, 1995, the entire contents of which are incorporated herein by reference.

In particular, these guidelines, which are well known in the art, provide a method of measuring and specifying color rendering properties of a light source based on resultant color shifts of test objects or samples. In general, eight (8) test-color samples are considered though fourteen (14) or more may be used depending on the application for which the light source is to be used.

In general, the CRI calculated in accordance with these guidelines compares the color differences of test-color samples when subjected to a test light source and a reference light source having a chromaticity proximal to that of the test light source. Such comparisons may be calculated, in various embodiments of the present invention, using a number of numerical, mathematical and/or experimental methods using known, calculated (e.g., interpolated, simulated, extrapolated, etc.) and/or measured illumination characteristics of the test and reference sources. For example, when the color rendering characteristics of the test light source approach those of the reference light source, the color-rendering index approaches a maximum CRI of one hundred (100). Furthermore, for example, when the color rendering characteristics of the test light source differ significantly from those of the reference light source, the color-rendering index will decrease toward a minimum CRI of zero (0).

The luminous efficacy ($\epsilon$) is a measure of a light source's efficiency in the visible spectrum. Generally, it is calculated as follows:

$$\varepsilon = \frac{D_{colour1}\varepsilon_{colour1d} + D_{colour2}\varepsilon_{colour2} + D_{colour}\varepsilon_{colour3} + D_{colour4}\varepsilon_{colour4}}{D_{colour1} + D_{colour2} + D_{colour3} + D_{colour4}} \quad (1)$$

where $D_{color[i]}$ is the duty cycle of a particular light-emitting element, or group, cluster or array thereof, and wherein $\epsilon_{color[i]}$ is the luminous efficacy of a particular light-emitting element, group or array. For example, colors 1 to 4 could be selected to include red, amber, green and blue, wherein the duty cycle and luminous efficacy of light-emitting elements of each of these colors are used in a calculation of the light sources luminous efficacy. Alternatively, colors 1 to 4 could include other color combinations, which could include various shades of red, orange, green, blue and/or indigo, as well as various types of white light-emitting elements. The person of skill in the art will understand that the above-listed colors are meant to be exemplary and may be varied according to the particular light-emitting elements used for a given light source, as can the total number of light-emitting elements, which, as presented above, is not limited to four.

The output power ($P_{out}$) is a measure of the photometric output power, which, in one embodiment, may be defined as:

$$P_{out} = k\int_{380nm}^{780nm} SPD(\lambda)\cdot V(\lambda)\cdot d\lambda \tag{2}$$

where k is a constant, SPD(λ) is the optical spectrum of the source and V(λ) is the human eye response curve as defined by CIE 15.2, Table 2.1, 1996, the entire contents of which are incorporated herein by reference. As would be known to a skilled worker, k is typically about 683 lm/W, however this value is generally of little significance when considering only relative power.

In general, the net optical spectrum of a given light source SPD(λ) may generally be defined by the sum of the optical spectrum of each LED, namely $SPD(\lambda)=SPD_1+SPD_2+SPD_3+SPD_4$ for a light source having four light-emitting elements. Again, as presented above, the total number of light-emitting elements within a given light source may not be limited to four, the net spectrum being defined in any case as the sum of all individual spectra from each of the light-emitting elements.

In one embodiment, it is assumed that each spectrum $SPD_i$ can be reasonably approximated as follows, as described in Ohno, Y., "Toward an Improved Color Rendering Metric", SPIE 2005, the entire contents of which being incorporated herein by reference:

$$SPD_i(\lambda, \lambda_0, \lambda_{1/2}) = \frac{I_0}{3}(g(\lambda, \lambda_0, \lambda_{1/2}) + 2g^5(\lambda, \lambda_0, \lambda_{1/2})) \tag{6}$$

where, $$g(\lambda, \lambda_0, \lambda_{1/2}) = e^{-\left(\frac{(\lambda-\lambda_0)}{\lambda_{1/2}}\right)^2} \tag{7}$$

and where λ is the wavelength, $\lambda_0$ is the peak wavelength, $\lambda_{1/2}$ is the full-width at half-maximum (FWHM) and $I_0$ is the intensity. As stated above, to obtain the net spectrum of a given light source, the spectra $SPD_i$ are summed using the respective parameters $\lambda_0$ and $\lambda_{1/2}$ for each respective light-emitting element, which may be derived experimentally for each light-emitting element, or group, cluster or array thereof, or obtained from a manufacturer of such light-emitting elements and generally indicative of an reasonably accurate value for each light-emitting element provided thereby.

The color quality scale (CQS) is a measure similar to the CRI that is currently being developed at the National Institute of Standards and Technology (NIST). Unlike the CRI, however, the CQS is meant to measure overall light quality, not simply color fidelity. The details of how the CQS is calculated are described in Ohno, Y., "Toward an Improved Color Rendering Metric", SPIE 2005, the entire contents of which are incorporated herein by reference. Calculations of the color quality scale for a given light source are readily achievable by a person of skill in the art and equally applicable in the present context in replacement or as a complement to color rendering index calculations.

Selection and Optimisation of Illumination Characteristic(s)

Most existing methods for optimisation are concerned with minimisation. The problem described in this work is one of maximisation (e.g. maximised CRI, ϵ, $P_{out}$, CQS, etc.). For simplicity, it is thus recast as a minimisation of a weighted illumination characteristic objective function expressed, for example, as:

$$f(IC_{i=1\to n}) = -\sum(\sigma_i IC_i^2)^{1/2} \tag{3}$$

where $IC_i$ represents respective illumination characteristics and $\sigma_i$ represent a respective optimisation weight associated therewith.

In one embodiment, the weighted illumination characteristic objective function is expressed as:

$$f(CRI, \varepsilon, \Delta xy) = -\left(\sigma_1 CRI^2 + \sigma_2\varepsilon^2 + \frac{\sigma_3}{\Delta xy^2}\right)^{1/2} \tag{4}$$

where $\sigma_i$ are the weighting parameters of each value, and where $$\Delta xy=\sqrt{(x-x_0)^2+(y-y_0)^2} \tag{5}$$

where (x,y) are the chromaticity coordinates of the source and $(x_0,y_0)$ are desired chromaticity coordinates.

In one embodiment, the above optimisation routine determines the optimal intensity ratios of the light-emitting elements. This optimisation may be implemented by selecting optimised drive parameters, such as the duty-cycle of each light-emitting element, the drive amplitude of each light-emitting element, or the like, and operating the light source in accordance with these optimised drive parameters. Other drive parameters, such as the current(s) for driving the light-emitting elements, the type of driving mechanism (e.g., pulse width modulation, pulse code modulation, etc.) and parameters thereof, the operating or junction temperature, and the like, may also be considered for optimisation as will be apparent to the person of skill in the art.

Since the method and algorithm can optimise for more than one characteristic, a weight (or importance level) is generally assigned to each characteristic (e.g. CRI, ϵ, Δxy). These weighting parameters $\sigma_i$ can be determined in a number of ways:

(a) trial and error;

(b) choosing $\sigma_1$ and $\sigma_2$ to give equal weight to the CRI and ϵ, and choosing $\sigma_3 >> (\sigma_1+\sigma_2)$ for Δxy>0 (or for Δxy>a certain tolerance related to a chromaticity requirement of the light source) and $\sigma_3=0$ elsewhere;

(c) choosing an arbitrary weighting of CRI/ϵ depending on their perceived importance and choosing $\sigma_3$ as in option (b);

(d) choosing $\sigma_1=1$, $\sigma_2=0$ and $\sigma_3$ as in option (b) to optimise for CRI only;

(e) choosing $\sigma_1=0$, $\sigma_2=1$ and $\sigma_3$ as in option (b) to optimise for ϵ only.

In one embodiment, the maximisation may further be performed on the output power $P_{out}$ and/or the CQS. Accordingly, equation (4) is modified as follows:

$$f(CRI, \varepsilon, \Delta xy, P_{out}, CQS) = -\left(\sigma_1 CRI_2 + \sigma_2 \varepsilon + \frac{\sigma_3}{\Delta xy^2} + \sigma_4 P_{out} + \sigma_5 CQS\right) \quad (6)$$

To avoid meaningless solutions to equation (6), the weighting parameters $\sigma_i$ should be chosen judiciously. For instance, one would generally set $\sigma_1=0$ or $\sigma_5=0$ so not to optimise for both CRI and CQS. Likewise, one would also generally set $\sigma_2=0$ or $\sigma_3=0$ so not to optimise for both $\epsilon$ and $P_{out}$.

To minimise $f$(CRI, $\epsilon$, $\Delta$xy) or $f$(CRI, $\epsilon$, $\Delta$xy, $P_{out}$, CQS), in one embodiment, the Nelder-Mead Simplex method is used, as outlined in Lagarias J., Reeds J., Wright M., and Wright P., "Convergence Properties of the Nelder-Mead Simplex Method in Low Dimensions", SIAM Journal of Optimisation, 9(1), 1998, the entire contents of which are incorporated herein by reference. This method may be implemented using a Matlab subroutine or any other such mathematical modeling software and/or hardware.

The Nelder-Mead Simplex method is generally for use with unconstrained problems. There are, however, a number of constraints on this problem, so the objective has been amended to approach zero for values outside the constraints. For instance, each light-emitting element must have a positive intensity and a duty cycle between 0 and 100%. Other such constraints will be apparent to the person of skill in the art.

In addition, the differences between the power levels of each light-emitting element (generally expressed in milliwatts or lumens) may be particularly pronounced at high temperatures. For example, as described above, the output power of an AlGaInP semiconductor used to create red and amber LEDs are significantly reduced at high temperatures. Consequently, in one embodiment, the above optimisation method is configured to produce solutions defining only attainable power levels. For instance, the optimisation may be configured to consider the intensity of each light-emitting element at the projected operating temperature of the light source.

Other effects that may be considered in various embodiments of the present invention may include, but are not limited to, spectral broadening, peak wavelength shift and forward voltage change, to name a few. Variations of this sort may affect the relative intensities required for an optimal solution, and as such, may be accounted for in the above model.

As will be apparent to the person of skill in the art, other derivative-based algorithms, such as a steepest descent algorithm, can also be used to provide similar results. For instance, several other derivative-based optimisation methods could also be used to evaluate the objective function (equations (3), (4) and/or (6)). Such methods can occasionally be more efficient than the Nelder-Mead method proposed herein, but require a numerical approximation of the derivative. Such an approximation can be imprecise at points far from the evaluation point. These may however be used to provide similar results.

Method of Operation

Figure 3:
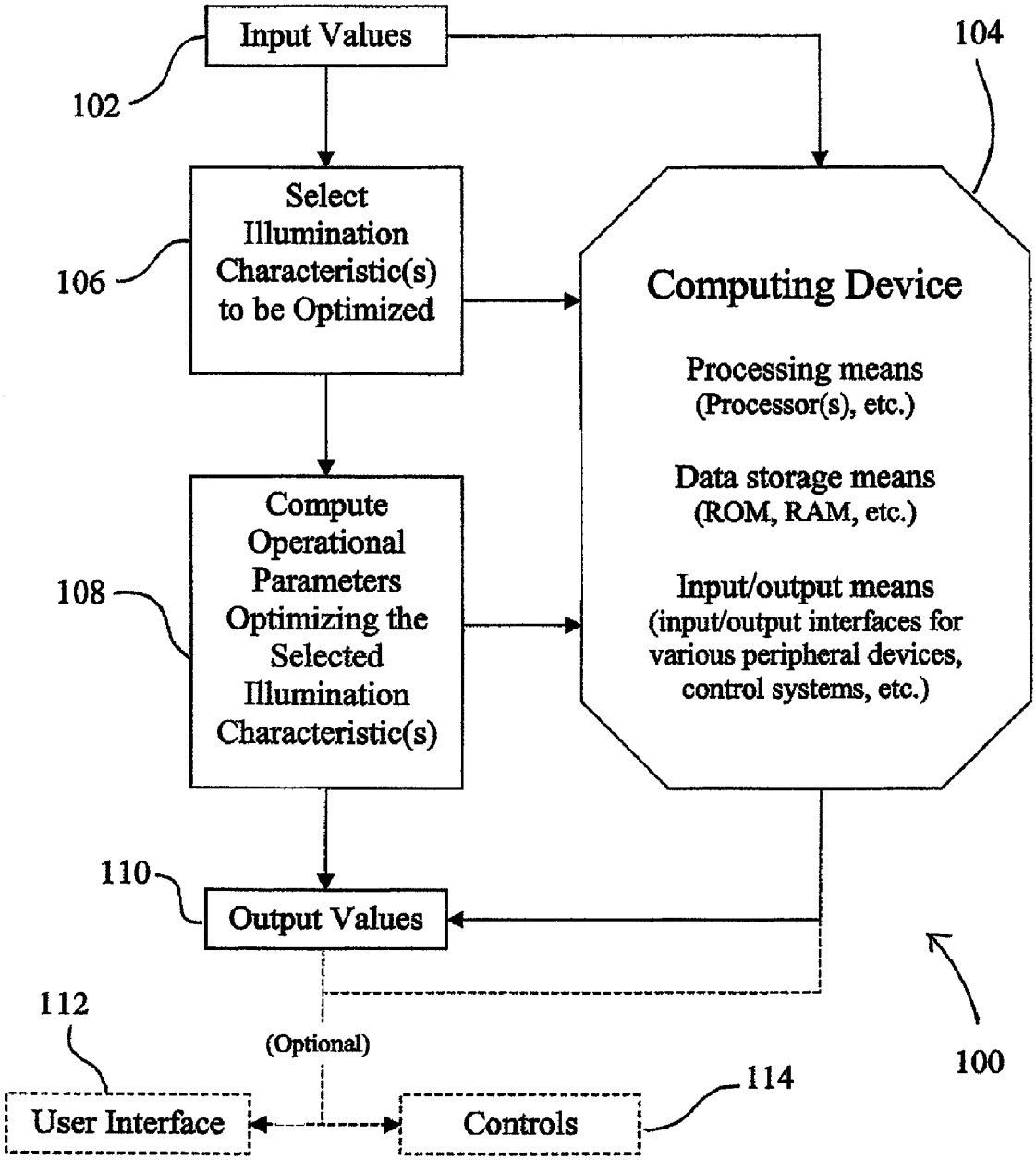
FIG. 3 is a high level flowchart illustrating steps of a method, illustratively implemented by a computing device, for optimising one or more illumination characteristics of a light source, in accordance with one embodiment of the present invention.

With reference to FIG. 3, a method 100 for optimising an illumination characteristic of a light source, as described above and in accordance with an embodiment of the present invention, may be schematically described as follows. In a first step 102, input values are entered or stored in a computing device or the like, as in device 104. These input values may include, but are not limited to, any combination of the peak emission wavelength (e.g., $\lambda_0$), the peak width (e.g., $\lambda_{1/2}$), the thermal degradation and the output power parameters of each light-emitting element, or group, cluster or array thereof, comprised in the light source 10.

Parameters associated with general color rendition and/or quality attributes of the light source 10, whether associated with each light-emitting element independently, in various configurations and/or combinations, or associated with the light source 10 as a whole, as well as attributes associated with any reference and/or test light source, may also be stored in device 104 for use in the various optimisation calculations described above. For instance, predetermined color rendition and/or quality functions may be stored to calculate, using various known and/or measured output parameters of the individual light-emitting elements and/or combined light source 10, various illumination characteristics of the light source 10 (e.g., direct calculations, interpolations and/or extrapolations from sample, test and/or batch data, iterative calculations from optical/electrical feedback measurements, etc.) Other such input parameters should be apparent to the person of skill in the art.

In step 106, the user of the method (e.g., light source designer, manufacturer, user, etc.) selects one or more illumination characteristics for which drive parameters are to be optimised. This may be implemented, as described above, via any type of user interface (e.g., a graphical user interface, an electric panel interface, a physical switch, etc., and/or a combination thereof) interactively coupled to hardware, software, firmware and/or a combination thereof (schematically illustrated in FIG. 3 as computing device 104).

Once the input values and selection are entered via steps 102 and 106, the computing device 106 proceeds in calculating, at step 108, the drive parameters of the light source that optimise the selected illumination characteristic, as described hereinabove. These parameters are then output at step 110 and optionally visually provided to the user in step 112 (as in FIGS. 2 and 5 to 7), or, in the event that the computing device 104 is operatively coupled to the light source, optionally used directly to control the output of the light source in step 114.

For instance, in one embodiment, the relative intensities of the light-emitting elements comprised in a given light source are converted into duty cycles to be used via a pulse-width modulator (PWM), or other similar drive techniques, to drive the given light source to provide the selected optimised illumination characteristic. Other examples of direct drive optimisations should be apparent to the person of skill in the art, and therefore, should not be considered to depart from the general scope and nature of the present disclosure.

The invention will now be described with reference to specific examples. It will be understood that the following examples are intended to describe embodiments of the invention and are not intended to limit the invention in any way.

EXAMPLES

Example 1

Figure 4:
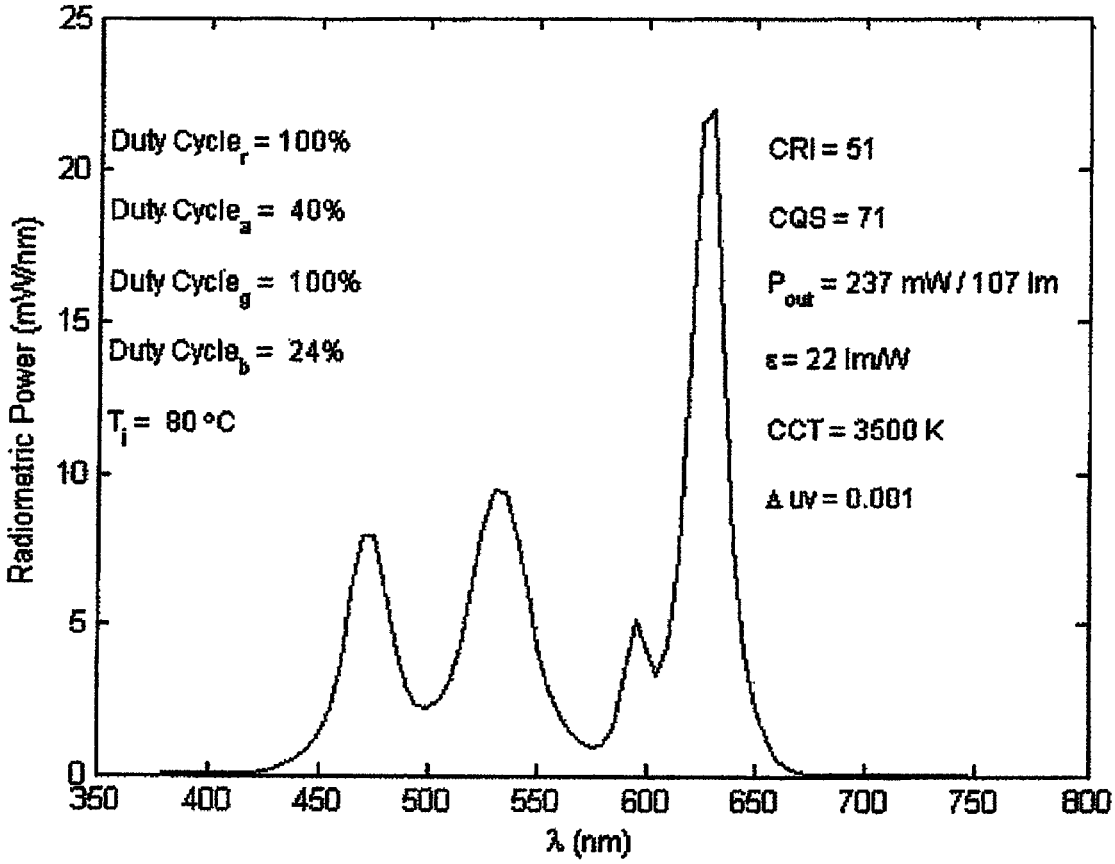
FIG. 4 is a graphical representation of non-optimised illumination characteristics and drive parameters of a RAGB light source.

FIG. 4 provides a graphical representation of the illumination characteristics and drive parameters of a RAGB light source. In this example, the light source was not optimised in accordance with an embodiment of the present invention, and as such, does not provide any optimised illumination characteristics.

Example 2

Figure 5:
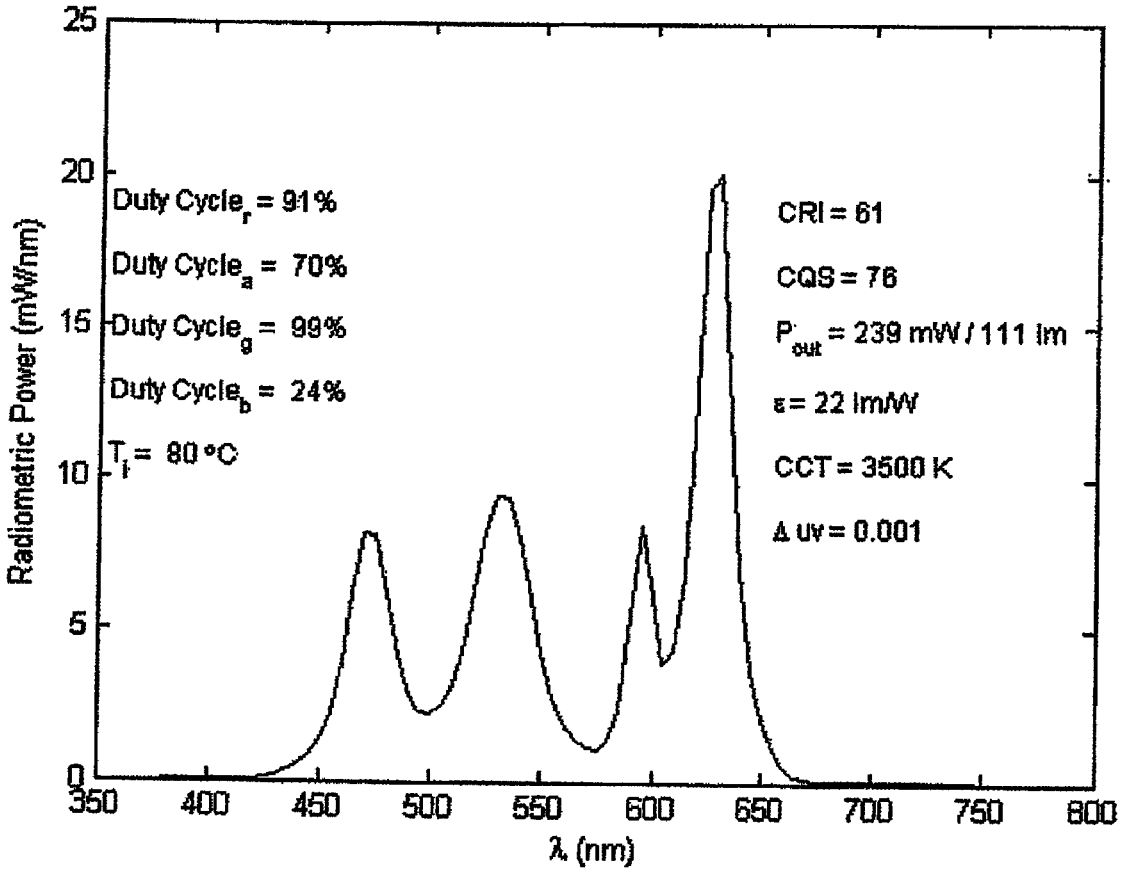
FIG. 5 is a graphical representation of illumination characteristics and drive parameters of a RAGB light source determined in accordance with one embodiment of the present invention to provide an optimised output power.

FIG. 5 provides a graphical representation of the illumination characteristics and drive parameters of a RAGB light source. In this example, the drive parameters of the light source (e.g., duty cycles) were optimised, in accordance with an embodiment of the present invention, to provide an optimised output power (i.e., $\sigma_1=\sigma_2=\sigma_5=0$, $\sigma_4=1$ in equation (6)). Results where obtained for an operating temperature of about 80° C. and a color temperature of about 3500 K.

Example 3

Figure 6:
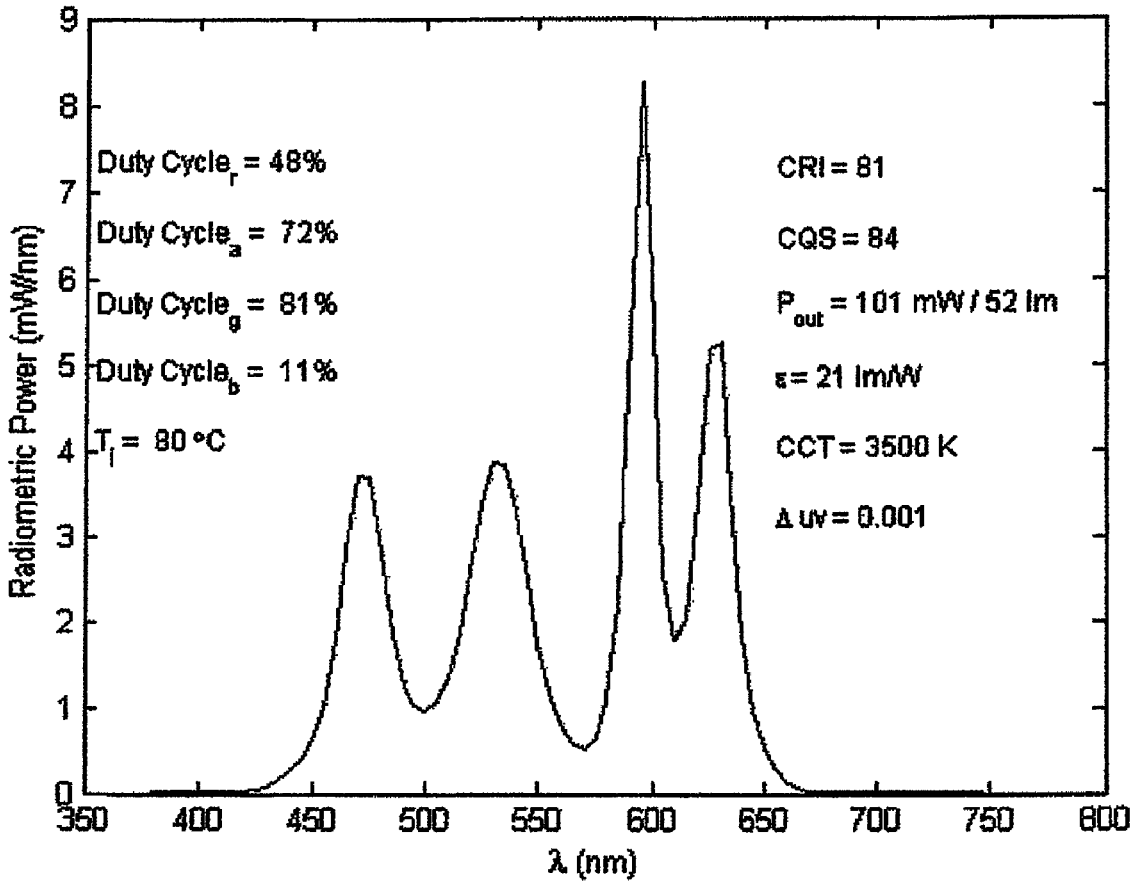
FIG. 6 is a graphical representation of illumination characteristics and drive parameters of a RAGB light source determined in accordance with one embodiment of the present invention to provide an optimised CRI.

FIG. 6 provides a graphical representation of the illumination characteristics and drive parameters of a RAGB light source. In this example, the drive parameters of the light source (e.g., duty cycles) were optimised, in accordance with an embodiment of the present invention, to provide an optimised CRI (i.e., $\sigma_1=1$ and $\sigma_2=\sigma_4=\sigma_5=0$ in equation (6)). Results where obtained for an operating temperature of about 80° C. and a color temperature of about 3500 K.

Example 4

Figure 7:
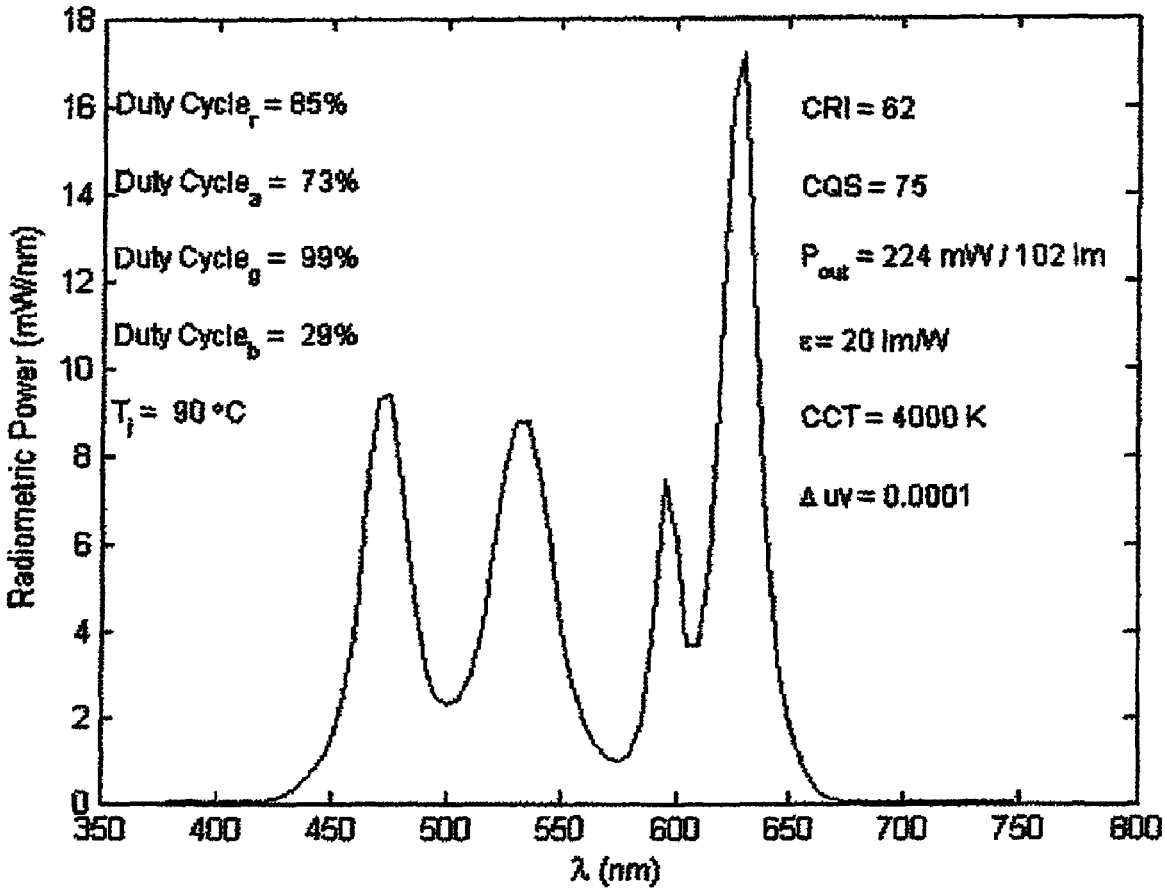
FIG. 7 is a graphical representation of illumination characteristics and drive parameters of a RAGB light source determined in accordance with one embodiment of the present invention to simultaneously provide an optimised CRI and luminous efficacy.

FIG. 7 provides a graphical representation of the illumination characteristics and drive parameters of a RAGB light source. In this example, the drive parameters of the light source (e.g., duty cycles) were optimised in accordance with an embodiment of the present invention, to simultaneously provide an optimised CRI and luminous efficacy (i.e., $\sigma_1=\sigma_2$ and $\sigma_4=\sigma_5=0$ in equation (6)). Results where obtained for an operating temperature of about 90° C. and a color temperature of about 4000 K.

Example 5

As described above, FIG. 2 provides a front face view of a control panel 28 according to one embodiment of the present invention, wherein the control panel may be coupled to a RGAB light source, as in for example the light source 10 of FIG. 1, to provide an optional user interface for interactively controlling an optimisation of one or more illumination characteristics of the light source. In this example, the selection switches 32 and 34 are respectively set to provide variable optimisation of the CQS and efficacy of the light source, while the slide bar 30 is positioned so to provide a sizeably higher weighting to the CQS than to the efficacy. Display means 36 provide readout of the light source's illumination characteristics established by the user-selected optimisation weighting.

The foregoing embodiments of the invention are examples and can be varied in many ways. Such present or future variations are not to be regarded as a departure from the spirit and scope of the invention, and all such modifications as would be apparent to one skilled in the art are intended to be included within the scope of the following claims.

We claim:

1. A light source, comprising:

four or more light-emitting elements, each one of which having a respective emission spectrum;

a selection module for selecting one or more illumination characteristics for which the light source is to be optimised;

a computing module for computing, from values indicative of each said respective emission spectrum, optimised drive parameters for driving the light source to substantially attain said selected one or more illumination characteristics; said selection module being configured to associate a respective optimisation weight to two or more of said illumination characteristics, wherein each said respective optimisation weight is used by said computing module when computing said optimised drive parameters; and a driving module for driving each of said four or more light-emitting elements in accordance with said optimised drive parameters.

2. The light source as claimed in claim 1, wherein said illumination characteristics are selected from the group consisting of: the color rendering index (CRI), the color quality scale (CQS), the luminous efficacy and the output power of the light source.

3. The light source as claimed in claim 1, wherein each said respective optimisation weight ranges substantially from 0 to 1.

4. The light source as claimed in claim 1, wherein selection of said respective optimisation weight for a given one of said illumination characteristics automatically selects said respective optimisation weight for another of said illumination characteristics according to a predefined relationship.

5. The light source as claimed in claim 4, wherein said respective optimisation weight for said given one of said illumination characteristics and said respective optimisation weight for said another one of said illumination characteristics add to 1.

6. The light source as claimed in claim 3, wherein said given one and said another one of said illuminations characteristics are respectively selected from the groups consisting of: the color rendering index (CRI) and the color quality scale (CQS) of the light source, and the luminous efficacy and the output power of the light source.

7. The light source as claimed in claim 1, wherein said drive parameters are selected from the group consisting of: output intensities, relative output intensities, drive currents, relative drive currents, duty cycles, relative duty cycles, and drive signal modulation parameters.

8. The light source as claimed in claim 1, wherein said selection module is selected from the group consisting of: one or more hardwired selection modules, one or more physical selection modules, one or more software selection modules, one or more firmware selection modules, and a combination thereof.

9. The light source as claimed in claim 1, wherein said selection module comprises a user interface enabling a user to select said one or more illumination characteristics for which the light source is to be optimised.

10. The light source as claimed in claim 1, further comprising a feedback module operatively coupled to said computing module for providing a feedback signal thereto indicative of one or more operational characteristics of the light source, wherein said computing module is further configured to account for said one or more operational characteristics and adjust said optimised drive parameters accordingly.

11. The light source as claimed in claim 1, wherein each of said light-emitting elements comprises one or more of a respective type of light-emitting element selected from the group consisting of: one or more substantially red light-emitting elements, one or more substantially amber light-emitting elements, one or more substantially orange light-emitting elements, one or more substantially green light-emitting elements, one or more substantially blue light-emitting elements, one or more substantially white light-emitting elements.

12. The light source as claimed in claim 1, wherein the light source is an RAGB light source.

13. The light source as claimed in claim 1, wherein each said respective optimisation weight is used by said computing module to compute said optimised drive parameters via an automated optimisation routine expressed as a minimisation of a weighted illumination characteristic objective function.

14. The light source as claimed in claim 13, wherein said weighted illumination characteristic objective function is expressed as:

$$f(IC_{i=1\to n})=-\Sigma(\sigma_i IC_i^2)^{1/2}$$

wherein ICi represents respective ones of said two or more illumination characteristics and of represent said respective optimisation weight associated therewith.

15. The light source as claimed in claim 14, wherein said weighted illumination characteristic objective function is expressed as:

$$f(CRI, \varepsilon, \Delta xy) = -\left(\sigma_1 CRI^2 + \sigma_2 \varepsilon^2 + \frac{\sigma_3}{\Delta xy^2}\right)^{1/2}$$

wherein said respective ones of said two or more illumination characteristics comprise a computable color rendering index (CRI), a computable luminous efficacy (ϵ) and a light source chromaticity variation (Δxy) from desired chromaticity coordinates.

16. The light source as claimed in claim 13, wherein said weighted illumination characteristic objective function is minimised via a Nelder-Mead Simplex method.

17. A method for driving a light source in accordance with drive parameters that optimise one or more illumination characteristics of the light source, the light source comprising four or more light-emitting elements each having a respective emission spectrum, the method comprising:

identifying for each of the four or more light emitting elements, one or more values indicative of its respective emission spectrum;

selecting the one or more illumination characteristics for which the light source is to be optimised;

associating a respective optimisation weight to each of said one or more selected illumination characteristics;

calculating, using each said one or more values, the drive parameters in accordance with each said respective optimisation weight that optimise for said selected one or more illumination characteristics; and driving the light source in accordance with said calculated drive parameters.

18. The method as claimed in claim 17, wherein said calculating step is performed via an automated optimisation routine.

19. The method as claimed in claim 18, wherein said automated optimisation routine comprises a Needler-Mead optimisation routine.

20. The method as claimed in claim 18, wherein said automated optimisation routine is implemented by a computing module operatively coupled a drive module of the light source and configured to automatically communicate said calculated drive parameters thereto to drive the light source in accordance therewith.

21. The method as claimed in claim 17, wherein said selecting step is implemented via a user interface of the light source.

22. The method as claimed in claim 20, wherein each said respective optimisation weight is used to compute the drive parameters via an automated optimisation routine expressed as a minimisation of a weighted illumination characteristic objective function.

23. The method as claimed in claim 22, wherein said weighted illumination characteristic objective function is expressed as:

$$f(IC_{i=1\to n})=-\Sigma(\sigma_i IC_i^2)^{1/2}$$

wherein ICi represents respective ones of said two or more illumination characteristics and of represent said respective optimisation weight associated therewith.

24. The method as claimed in claim 23, wherein said weighted illumination characteristic objective function is expressed as:

$$f(CRI, \varepsilon, \Delta xy) = -\left(\sigma_1 CRI^2 + \sigma_2 \varepsilon^2 + \frac{\sigma_3}{\Delta xy^2}\right)^{1/2}$$

wherein said respective ones of said two or more illumination characteristics comprise a computable color rendering index (CRI), a computable luminous efficacy (ϵ) and a light source chromaticity variation (Δxy) from desired chromaticity coordinates.

* * * * *